US005669362A

United States Patent [19]

Shinohara et al.

[11] Patent Number: 5,669,362

[45] Date of Patent: Sep. 23, 1997

[54] DIAGNOSTIC DEVICE FOR AN EVAPORATIVE EMISSION CONTROL SYSTEM

[75] Inventors: Susumu Shinohara, Toyota; Shinsuke Kiyomiya, Seto, both of Japan

[73] Assignee: Toyota Jidosha Kabushiki Kaisha, Aichi, Japan

[21] Appl. No.: 617,252

[22] Filed: Mar. 18, 1996

[30] Foreign Application Priority Data

Mar. 20, 1995 [JP] Japan ..... 7-060858

[51] Int. Cl.[6] ..... F02M 37/04

[52] U.S. Cl. ..... 123/520

[58] Field of Search ..... 123/516, 518, 123/519, 520, 198 D, 479

[56] References Cited

U.S. PATENT DOCUMENTS

| | | | |
|---|---|---|---|
| 4,949,695 | 8/1990 | Uranishi et al. | 123/520 |
| 5,295,472 | 3/1994 | Otsuka et al. | 123/520 |
| 5,299,544 | 4/1994 | Kitamoto et al. | 123/520 |
| 5,355,863 | 10/1994 | Yamanaka et al. | 123/520 |
| 5,373,823 | 12/1994 | Kuroda et al. | 123/520 |
| 5,494,021 | 2/1996 | Yoneyama | 123/520 |
| 5,497,754 | 3/1996 | Ito | 123/520 |

FOREIGN PATENT DOCUMENTS

| | | |
|---|---|---|
| 4-362264 | 12/1992 | Japan . |
| 5-39754 | 2/1993 | Japan . |
| 6-42414 | 2/1994 | Japan . |

*Primary Examiner*—Thomas N. Moulis
*Attorney, Agent, or Firm*—Kenyon & Kenyon

[57] ABSTRACT

In an evaporative emission control system, a canister adsorbs fuel vapor sent from a fuel tank of an engine. The canister is connected to an intake air passage through a purge gas passage and a purge control valve. A control circuit employs a pressure sensor to detect the pressure of the canister when the purge control valve is closed and when the pressure of the canister is stabilized. The control circuit carries out a failure diagnosis based on this pressure. Namely, when the pressure of the canister after it is stabilized deviates from the atmospheric pressure by more than a predetermined reference value, the control circuit determines that the canister has failed, i.e., the canister has a leak. Since the diagnosis can be carried out before starting the engine, the diagnosis can be correctly carried out without affecting the operation of the engine.

4 Claims, 9 Drawing Sheets

DIAGNOSTIC DEVICE FOR AN EVAPORATIVE EMISSION CONTROL SYSTEM

BACKGROUND OF THE INVENTION

1. Field of the Invention

The present invention relates to an evaporative emission control system for preventing emission of fuel vapor from a fuel tank to the atmosphere, and particularly, to a diagnostic device for the evaporative emission control system.

2. Description of the Related Art

To prevent a release of fuel vapor from a fuel tank of an internal combustion engine to the atmosphere, an evaporative emission control system which is equipped with a canister containing an adsorbent for adsorbing the fuel vapor from a fuel tank is commonly used. In the evaporative emission control system, when the engine is operated under predetermined conditions, air is passed through the canister, to release the adsorbed fuel from the adsorbent. A mixed gas of the air and released fuel is purged from the canister (in this specification, this mixture of air and the fuel vapor purged from the adsorbent is referred to as "purge gas"), is fed to an intake air passage of the engine and is burned in the engine.

If this system fails, the fuel vapor will leak outside and pollute the atmosphere. For example, if the canister or a pipe that connects the canister to the intake air passage is broken, the fuel vapor will leak through the broken part into the atmosphere. However, even if such failure occurs in the evaporative emission control system, the operation of the engine is not affected, and therefore, the driver will never notice the failure and will continue to drive the vehicle. To prevent this from occurring, various devices have been proposed to diagnose and detect a failure in the evaporative emission control system and inform the driver of any trouble.

An example of a diagnostic device is disclosed in Japanese Unexamined Patent Publication No. 4-362264. In this publication, a purge control valve is disposed in a purge gas passage which connects a canister to an intake air passage of an engine. Just after the engine is started and when the temperature of the engine is below a given value, the device in the '264 publication opens the purge control valve to introduce a negative pressure of the intake air passage into the canister, and then, closes the purge control valve. If the pressure of the canister increases within a predetermined period, it is determined that the canister has a problem such as a leak. When the purge control valve is opened to introduce the negative pressure of the intake air passage into the canister and is closed to keep the negative pressure in the canister, outside air will enter the canister to increase the pressure thereof if the canister has a leak. The device in the '264 publication determines that the canister has failed if the pressure thereof increases after the purge control valve is closed. However, if the diagnosis is carried out when the temperature of the fuel is high, fuel vapor from the fuel tank will enter the canister after the purge control valve is closed. This causes the pressure of the canister to increase even if the canister has not failed. This results in an error in the diagnosis.

To avoid the problem, the device in the '264 publication carries out the failure diagnosis only when the temperature of fuel is sufficiently low to make sure that no fuel vapor will be sent from the fuel tank to the canister after the purge control valve is closed. However, since the diagnostic device in '264 publication carries out the failure diagnosis only when the engine is started with a low fuel temperature, in order to avoid an error in the diagnosis, the device does not carry out the diagnosis when the engine is hot started, i.e., when the engine is started with a high fuel temperature. Therefore, the frequency of failure diagnoses in the '264 publication becomes relatively low, thereby the chances to detect a failure in the evaporative emission control system becomes also low. Further, the device in the '264 publication may cause an error in the diagnosis, even if the temperature of fuel is low just after the start of the engine. This is because a change in the pressure of the canister after the purge control valve is closed is irrelevant to a leak in the canister when the flow rate of the purge gas flowing from the canister to the intake air passage is excessively large or small. This problem will be explained later in detail.

SUMMARY OF THE INVENTION

In view of the problems set forth above, the object of the present invention is to provide a diagnostic device for an evaporative emission control system which is capable of carrying out a failure diagnosis correctly even if the temperature of the fuel is high. Further, another object of the present invention is to provide a diagnostic device for an evaporative emission control system which is capable of preventing an error in the diagnosis by prohibiting the failure diagnosis in the conditions in which an error is possible.

The above-mentioned object is achieved by a diagnostic device for an evaporative emission control system, in which the device comprises a canister for adsorbing fuel vapor sent from a fuel tank for an internal combustion engine, a fuel vapor passage for connecting a space above a fuel level in the fuel tank to the canister, a purge gas passage for connecting the canister to an intake air passage of the engine, and a purge control valve for opening and closing the purge gas passage. The device further comprises a pressure detecting device for detecting the internal pressure of the canister and determining means for determining that the canister is normal if the difference between the internal pressure of the canister detected by the pressure detecting device and the atmospheric pressure is greater than a reference value, when the purge control valve is closed and the internal pressure is stable.

In this device, the determination means determines that canister has no leak and is normal if the difference between the internal pressure of the canister and the atmospheric pressure after the purge control valve is closed is greater than the reference value. When the canister has no leak, the internal pressure of the canister after the purge control valve is closed is maintained at a negative pressure (i.e., a pressure lower than the atmospheric pressure), or alternatively, the internal pressure in the canister is maintained at a positive pressure (i.e., a pressure higher than the atmospheric pressure) because of fuel vapor flowing into the canister from the fuel tank. If the canister leaks, the pressure of the canister becomes nearly equal to the atmospheric pressure when a certain period has elapsed after the closure of the purge control valve. Therefore, if the pressure of the canister after the closure of the purge control valve is higher than a predetermined positive pressure, or lower than a predetermined negative pressure, it is considered that the canister has no failure such as a leak.

According to another aspect of the present invention, there is provided a diagnostic device for an evaporative emission control system which comprises a canister for adsorbing fuel vapor sent from a fuel tank of an internal combustion engine, a fuel vapor passage for connecting a space above a fuel level in the fuel tank to the canister, and a purge gas passage for connecting the canister to an intake air passage of the engine, a purge control valve for controlling the flow rate of purge gas from the canister flowing into the intake air passage through the purge gas passage, an atmospheric valve attached to the canister which opens when the internal pressure of the canister becomes lower than the atmospheric pressure by more than a predetermined amount, to thereby introduce air into the canister, a pressure detecting device for detecting the internal pressure of the canister, determining means for determining that the canister has failed if an increase in the internal pressure of the canister within a predetermined period after the purge control valve is closed is greater than a reference value during the operation of the engine, means for detecting the flow rate of the purge gas when the purge control valve is opened, and means for prohibiting the determination means from determining that the canister has failed when the flow rate of the purge gas is greater than a reference value.

According to this aspect of the present invention, the determining means determines that the canister has failed if an increase in the internal pressure of the canister after the purge control valve is closed is greater than the reference value. The prohibition means prohibits the determining means from determining a failure if the flow rate of the purge gas through the purge control valve is greater than the reference value. When the flow rate of the purge gas is large, the flow rate of air passing through the atmospheric valve into the canister is also large. This means that the degree of opening of the atmospheric valve is large when the flow rate of the purge gas is large, and that a relatively long time is required for the atmospheric valve to close completely after the purge control valve is closed. In this case, the internal pressure in the canister increases even after the purge control valve is closed due to air flow into the canister through the atmospheric valve. Under this condition, an error may occur if the failure determination is carried out. In this aspect of the present invention, the error in the failure detection is prevented by prohibiting the failure determination by the determining means in such a condition.

According to another aspect of the present invention, there is provided a diagnostic device for an evaporative emission control system, which comprises a canister for adsorbing fuel vapor sent from a fuel tank of an internal combustion engine, a fuel vapor passage for connecting a space above a fuel level in the fuel tank to the canister, and a purge gas passage for connecting the canister to an intake air passage of the engine, a purge control valve for controlling the flow rate of purge gas from the canister flowing into the intake air passage through the purge gas passage, an atmospheric valve attached to the canister which opens when the internal pressure of the canister becomes lower than the atmospheric pressure by more than a predetermined amount, to thereby introduce air into the canister, a pressure detecting device for detecting the internal pressure of the canister, determining means for determining that the canister has failed if an increase in the internal pressure of the canister within a predetermined period after the purge control valve is closed is greater than a reference value during the operation of the engine, means for detecting the flow rate of the purge gas when the purge control valve is opened, and means for setting the reference value according to the flow rate of the purge gas.

According to this aspect of the present invention, the determining means determines that the canister has failed if an increase in the internal pressure of the canister after the purge control valve is closed is greater than the reference value. The setting means sets the reference value in accordance with the flow rate of the purge gas through the purge control valve. When the flow rate is large, the difference between the internal pressure of the canister and the atmospheric pressure is large, and therefore, an increase in the internal pressure of the canister after the purge control valve is closed is large if the canister has a leak. When the flow rate of the purge gas is small, the difference between the internal pressure of the canister and the atmospheric pressure is small, and therefore, an increase in the internal pressure of the canister after the purge control valve is closed becomes small even if the canister has a leak. If a same reference value is used for determining failure of the canister in all cases, an error in the diagnosis may occur depending on the flow rate of the purge gas. In this aspect of the invention, since the reference value is changed in accordance with the flow rate of the purge gas, the failure diagnosis is performed correctly regardless of the flow rate of the purge gas.

According to another aspect of the present invention, there is provided a diagnostic device, for an evaporative emission control system, which comprises a canister for adsorbing fuel vapor sent from a fuel tank of an internal combustion engine, a fuel vapor passage for connecting a space above a fuel level in the fuel tank to the canister, and a purge gas passage for connecting the canister to an intake air passage of the engine, a purge control valve for controlling the flow rate of purge gas from the canister flowing into the intake air passage through the purge gas passage, a pressure detecting device for detecting the internal pressure of the canister, first determining means for determining that the canister has failed if an increase in the internal pressure of the canister within a predetermined period after the purge control valve is closed is greater than a first reference value during the operation of the engine, and second determining means for determining, when the first determining means has determined that the canister has failed, that the canister is normal if an increase in the internal pressure of the canister is greater than a second reference value within a predetermined period that starts when a predetermined time has elapsed after the first determining means has determined that the canister has failed.

In this aspect of the invention, the first determining means determines that the canister has failed if an increase in the internal pressure of the canister after the purge control valve is closed is greater than the first reference value. However, when the first determining means determines that the canister has failed, the second determining means determines whether the canister has really failed in a predetermined period after the first determination is carried out. If an increase in the internal pressure of the canister in the predetermined period is greater than the second reference value, the second determining means determines that the canister is normal regardless of the determination of the first determining means. Since the first determining means carries out the determination in a transition period of the internal pressure of the canister just after the purge control valve is closed, various factors such as the temperature of fuel in the fuel tank may affect the change in the internal pressure of the canister and, thereby an error may occur in the determination by the first determining means. However, if the canister has a leak, the internal pressure of the canister is stabilized around the atmospheric pressure when a certain period has lapsed after the closure of the purge control valve. In contrast to this, if the canister has no leak, the internal pressure of the canister continuously increases above the atmospheric pressure due to fuel vapor flowing into the canister from the fuel tank. Therefore, in this aspect of the invention, the second determining means determines that the canister is normal even if the first determining means determined that the canister has failed, when the internal pressure of the canister continuously increases, to thereby correct the error in the diagnosis by the first determining means.

BRIEF DESCRIPTION OF THE DRAWINGS

The present invention will be better understood from the description as set forth hereinafter, with reference to the accompanying drawings, in which.

DESCRIPTION OF PREFERRED EMBODIMENTS

Embodiments of the present invention will be explained with reference to the accompanying drawings.

Figure 1:
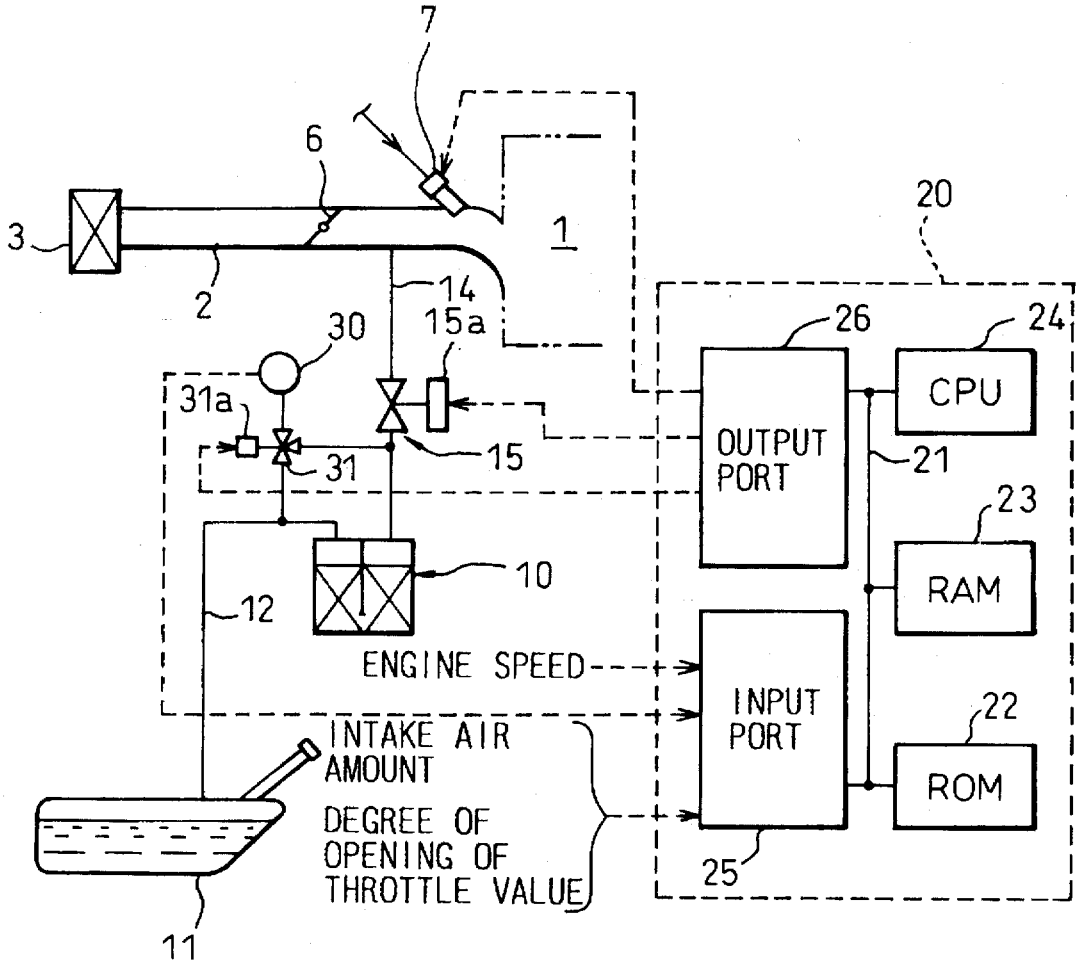
FIG. 1 is a drawing schematically illustrating an embodiment of a diagnostic device for an evaporative emission control system according to the present invention when applied to an automobile engine.

FIG. 1 shows an internal combustion engine of an automobile to which the present invention is applied. In FIG. 1, reference numeral 1 designates an internal combustion engine for an automobile, numeral 2 designates an intake air passage of the engine 1, numeral 3 designates an air-cleaner disposed in the intake air passage 2. In the intake air passage 2, a throttle valve 6, which takes a degree of opening determined by the amount of depression of an accelerator pedal (not shown in the drawing) by the driver of the automobile, is disposed. Fuel in a fuel tank 11 is pressurized by a fuel pump (not shown) and is sent to a fuel injector 7 arranged in the intake air passage 2. The fuel injector 7 injects fuel into an intake port of each cylinder of the engine 1 in response to a signal from a control circuit 20.

Numeral 20 in FIG. 1 denotes a control circuit of the engine 1. The control circuit 20 may, for example, consist of a microcomputer of a conventional type which comprises a ROM (read-only memory) 22, a RAM (random access memory) 23, a CPU (microprocessor) 24, an input port 25 and an output port 26 connected one another by a bi-directional bus 21. The control circuit 20 performs basic engine control such as fuel injection control and ignition timing control of the engine 1. Further, in this embodiment, the control circuit 20 performs failure diagnosis of the evaporative emission control system as explained later in detail.

To perform these types of control, the output port 26 of the control circuit 20 is connected to the fuel injector 7 through a drive circuit (not shown), to control an opening period, i.e., the fuel injection amount of the fuel injector 7. The output port 26 is also connected to a purge control valve 15, to control the degree of opening thereof. The input port 25 receives an engine speed from an engine speed signal sensor disposed signal at a crankshaft of the engine 1. The input port 25 also receives, through A/D (analog-to-digital) converters (not shown), a signal indicating the amount of intake air from an air flow meter disposed in the intake air passage 2, a signal indicating the degree of opening of the throttle valve 6 from a throttle opening sensor disposed at the throttle valve 6, and a signal from a pressure sensor 30. The pressure sensor 30 will be explained later.

Numeral 10 in FIG. 1 denotes a canister for adsorbing fuel vapor evaporated from the fuel in the fuel tank 11. The canister 10 is connected to a space above a fuel level in the fuel tank 11 through a fuel vapor passage 12, and to the intake air passage 2 downstream of the throttle valve 6 through a purge gas passage 14.

Numeral 15 in FIG. 1 denotes a purge control valve 15 which controls the flow rate of the purge gas from the canister 10 into the intake air passage 2 through the purge gas passage 14. The purge control valve 15 has, for example, a solenoid actuator. The control circuit 20 changes the duty ratio (the ratio of the length of an ON period to the length of one ON-OFF cycle period) of a pulse voltage signal for driving the solenoid actuator, to thereby control the degree of opening of the valve 15. The valve 15 is not limited to the solenoid type. For example, the valve 15 may be driven by a diaphragm type negative pressure actuator. In this case, the negative pressure applied to the negative pressure actuator is controlled by a negative pressure control valve which is driven by a pulse voltage signal from the control circuit 20. Namely, the duty ratio of the drive pulse of the negative pressure control valve may be changed to control the degree of opening of the valve 15.

Figure 2:
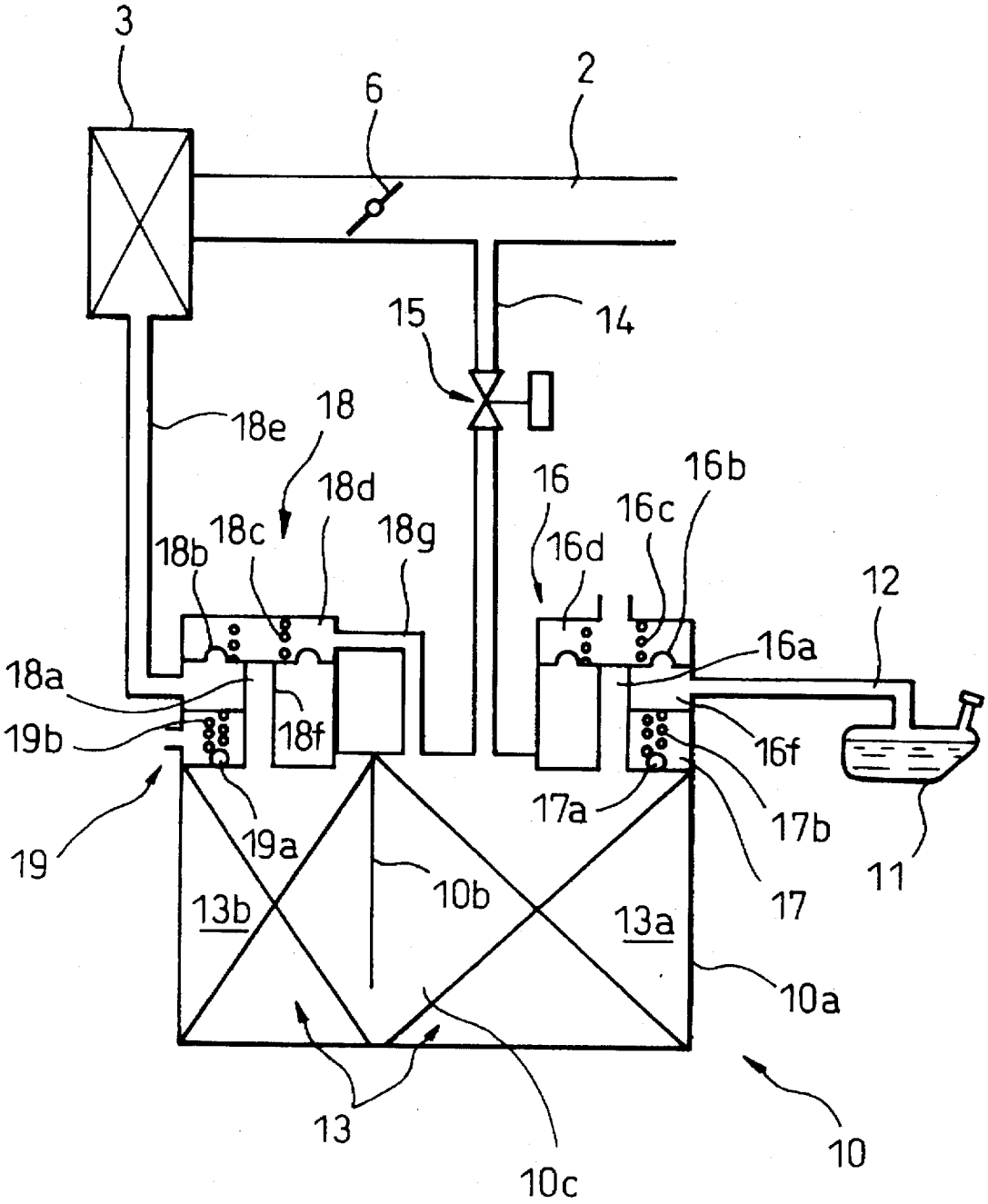
FIG. 2 is a drawing schematically illustrating a typical construction of the canister used in the evaporative emission control system.

FIG. 2 illustrates the construction of the canister 10 in FIG. 1. Typically, the canister 10 comprises a housing **10*a* and a fuel vapor adsorbent 13, such as active carbon, filled in the housing 10*a*. On the housing 10*a*, an internal pressure control valve 16 and an atmospheric valve 18 are provided to control the operation for adsorption of fuel vapor to the adsorbent 13 and releasing of the adsorbed fuel vapor from the adsorbent (i.e., purging of fuel vapor from the adsorbent 13**). The operation for adsorption and purging of fuel vapor will be explained later.

In the housing **10*a*, a partition plate 10*b* is disposed at the position between the internal pressure control valve 16 and the atmospheric valve 18. The adsorbent 13 in the housing 10*a* is divided by the partition plate 10*b* into two sections, i.e., the section 13*a* on the internal pressure control valve 16 side and the section 13*b* on the atmospheric valve 18 side. On the partition plate 10*b*, an aperture 10*c* which communicates with the section 13*a* and the section 13*b* is provided on the opposite end thereof to the valves 16 and 18**.

The internal pressure control valve 16 comprises a port **16*a* communicating with the inside of the housing 10*a* and a diaphragm 16*b*. The diaphragm 16*b* is urged by the spring 16*c* to the port 16*a* so that the port 16*a* is closed by the diaphragm 16*b*. A pressure chamber 16*d* is formed on the spring 16*c* side of the diaphragm and communicates with the atmosphere. Further, another pressure chamber 16*f* which communicates with the fuel tank 11*a* via the fuel vapor passage 12 is formed on the side of the diaphragm 16*b*** opposite to the pressure chamber 16*d*. The pressure chamber 16*f* communicates with the inside of the housing 10*a* via a pressure equalizing valve 17 having a check ball 17*a* and spring 17*b*.

The atmospheric valve 18 has a construction similar to that of the internal pressure control valve 16 and comprises a port 18*a* communicating with the inside of the housing 10*a*, a diaphragm 18*b* and a spring 18*c*. However, in the atmospheric valve 18, a pressure chamber 18*d* formed on the spring 18*c* side of the diaphragm 18*b* is connected to the section 13*a*, which is formed on the internal pressure control valve 16 side in the housing 10*a*, through a pipe 18*g*. Further, a pressure chamber 18*f* formed on the side of the diaphragm 18*b*opposite to the pressure chamber 18*d* connected to the air-cleaner 3 via a pipe 18*e*. The section 13*b* of the adsorbent 13 inside the housing 10*a* is connected to the atmosphere via a relief valve 19 comprising a check ball 19*a* and a spring 19*b*. The purge gas passage 14, as stated before, is connected to the section 13*a* of the adsorbent 13 which is located on the internal pressure control valve 16 side in the housing 10*a*.

Next, the operation of adsorbing and purging of fuel vapor using the canister 10 is explained with reference to FIG. 2. In FIG. 2, when the fuel temperature rises with the internal purge control valve 15 being closed, the pressure in the fuel tank 11 increases due to evaporation of fuel inside the fuel tank 11. Since the fuel vapor space above the fuel level in the fuel tank 11 communicates with the pressure chamber 16*f* in the internal pressure control valve 16, the pressure in the pressure chamber 16*f* also increases due to pressure rise in the fuel tank 11. Further, an atmospheric pressure is introduced to the pressure chamber 16*d* which is on the side of the diaphragm 16*b* opposite to the pressure chamber 16*f*, through the port 16*e*. Therefore, when the pressure in the fuel tank 11 becomes higher than the atmospheric pressure by a predetermined amount, the pressure inside the pressure chamber 16*f* moves the diaphragm 16*b* against the urging force of the spring 16*c*. This causes the port 16*a* to open and, thereby, fuel vapor in the tank 11 flows into the housing 10*a*. Due to this fuel vapor, the pressure inside the housing 10*a* also increases, and the increased pressure in the housing pushes the check ball 19*a* of the atmospheric valve 19 against the urging force of the spring 19*b*. This causes the section 13*b* in the housing 10*a* to communicate with atmosphere through the atmospheric valve 19. When the section 13*b* communicates with atmosphere, a mixture of fuel vapor and air from the fuel tank 11 flows into the canister 10 through the port 16*a*, and flows through the sections 13*a* and 13*b* of the absorbent 13 to the atmospheric valve 19. When the mixture flows through the adsorbent 13, fuel vapor is adsorbed by the adsorbent 13, and only air is released from the atmospheric valve 19 to the atmosphere. The force of the spring of the atmospheric valve 19 is set in such a manner that the atmospheric valve 19 opens when the pressure inside the canister 10 becomes only slightly higher than the atmospheric pressure. Therefore, when the pressure in the fuel tank 11 reaches the pressure at which the internal pressure control valve 16 opens (for example, about 1 Kpa (100 mmAq) above the atmospheric pressure), the fuel tank 11 communicates with atmosphere through the canister 10, and the pressure in the fuel tank 11 is kept lower than or equal to the above mentioned predetermined pressure.

Further, when the engine 1 is operated at a predetermined operating condition, the purge control valve 15 is opened. This causes the section 13*a* in the housing 10*a* to communicate with the intake air passage 2 at the portion downstream of the throttle valve 6 through the purge gas passage 14. When this occurs, a negative pressure in the intake air passage 2 downstream of the throttle valve 6 is introduced to the housing 10*a* and lowers the pressure inside the housing 10*a*. Since the pressure chamber 18*d* in the atmospheric valve 18 is connected to the section 13*a* inside the housing 10*a* through the pipe 18*g*, the pressure in the pressure chamber 18*d* also becomes lower than the atmospheric pressure. Thereby, the diaphragm 18*b* is pushed by the pressure in the pressure chamber 18*f* which is connected to the air-cleaner 3 by the pipe 18*e* to open the port 18*a* against the urging force of the spring 18*c*. Thus, clean air from the air-cleaner 3 flows into the section 13*b* in the housing 10*a* through the pipe 19*e* and the port 18*a*. This clean air flows through the sections 13*b* and 13*a* of the adsorbent 13, then, flows into the intake air passage 2 via the purge gas passage 14. When the air flows through the adsorbent 13, the fuel vapor adsorbed by the adsorbent 13 is released (purged) from the adsorbent and, thereby, the adsorbent 13 is prevented from being saturated with fuel vapor. Fuel vapor released from the adsorbent 13 mixes with clean air from the air-cleaner 3, and forms a mixture of air and fuel vapor (i.e., purge gas). Since this purge gas is fed to the engine 1 and burned in the combustion chamber thereof, emission of the evaporated fuel from the fuel tank 11 is prevented. The spring 18*c* of the atmospheric valve 18 is set in such a manner that the atmospheric valve 18 opens when the pressure inside the canister 10 becomes lower than the atmospheric pressure by, for example, about 1.5 Kpa (150 mmaq) to introduce clean air from the air-cleaner 3 into the canister 10.

Further, when the engine is stopped, the temperature of the fuel in the fuel tank becomes low and, thereby, the pressure in the fuel tank 11 decreases. When the pressure in the fuel tank 11 becomes lower than the pressure in the canister 10, the equalizing valve 17 is opened by the pressure in the canister 10, and the canister 10 is connected to the fuel tank 11 by the fuel vapor passage 12. Therefore, when the pressure in the fuel tank 11 becomes lower than the atmospheric pressure, the pressure in the canister housing 10*a* also becomes lower than the atmospheric pressure and, thereby, the atmospheric valve 18 opens. This causes the clean air from the air-cleaner 3 to be introduced into the canister housing 10*a*, and it flows into the fuel tank 11 through the adsorbent 13, equalizing valve 17 and the fuel vapor passage 12. Therefore, the pressure in the fuel tank 11 does not become excessively low even when the temperature of the fuel in the tank 11 becomes low. The spring 17*b* in this embodiment is set in such a manner that the equalizing valve 17 opens when the pressure in the fuel tank 11 becomes lower than the pressure in the canister housing 10*a* by, for example, about 0.5 Kpa (50 mmAq).

As explained above, if the elements in the evaporative emission control system such as the canister 10 work properly, the adsorbent 13 in the canister 10 adsorbs and releases fuel vapor in accordance with opening and closing of the purge control valve 15 to prevent emission of fuel vapor to atmosphere. However, if one of the elements fails, emission of fuel vapor may occur. Typically, if the housing 10*a* of the canister 10 has a leak, fuel in the fuel tank 11 and canister 10 may leak into the atmosphere.

In this embodiment, a pressure sensor 30 (FIG. 1) is provided in order to detect such a failure. The pressure sensor 30 generates a voltage signal corresponding to the difference between the pressure to be detected and the atmospheric pressure, and this analogue voltage signal is fed to the input port 25 of the control circuit 20 after it is converted to digital signal by an A/D converter (not shown).

The pressure sensor 30 is connected to the fuel vapor passage 12 and the portion of the purge gas passage 14 between the canister 10 and the purge control valve 15 via a three-way switching valve 31 so that it can detect the pressure in the fuel vapor passage 12 (i.e., the pressure in the fuel tank 11) and the pressure in the purge gas passage 14 (i.e., the pressure in the canister housing 10*a*) selectively by switching the three-way switching valve 31. Numeral 31*a* in FIG. 1 shows an actuator of appropriate type, such as a solenoid actuator or a diaphragm type negative pressure actuator. The actuator 31*a* is connected to the output port 26 of the control circuit 20 via a drive circuit (not shown) and switches the three-way switching valve 31 in response to a driving signal from the control circuit 20.

Next, a detecting operation of a failure by the diagnostic device for the evaporative emission control system according to the present embodiment will be explained.

In this embodiment, the diagnostic device diagnoses the canister 10 when the purge control valve 15 is closed and when the internal pressure of the canister 10 is stable.

If the canister 10 has a failure such as a leak under this condition, the internal pressure of the canister 10 is equalized to the atmospheric pressure irrelevant to the pressure of the canister 10 at the time when the purge control valve 15 is closed or the temperature of fuel in the fuel tank 11.

If the pressure of the canister 10 is negative when the purge control valve 15 is closed, the pressure of the canister 10 increases if the canister 10 has a leak because air enters the canister 10 from the outside through the leak and, after a certain period, the pressure of the canister 10 becomes equal to the atmospheric pressure.

When the temperature of fuel in the fuel tank 11 is high and the pressure of fuel vapor in the fuel tank 11 is high, the fuel vapor flows from the fuel tank 11 into the canister 10 through the internal pressure control valve 16. If the canister 10 has a leak, the fuel vapor (or a remnant of air after the fuel vapor is adsorbed by the adsorbent 13) flows out from the canister 10 through the leak. As a result, the pressure of the canister 10 becomes equal to the atmospheric pressure.

If the canister 10 has no leak and if the temperature of the fuel is low, the negative pressure of the canister 10 at the closure of the purge control valve 15 is maintained even after the purge control valve 15 closed. Namely, the pressure of the canister 10 stays always negative. If the temperature of the fuel is high and the pressure of the fuel tank 11 is higher than the opening pressure of the valve 16, fuel vapor flows from the fuel tank 11 into the canister 10 and, thereby the pressure of the canister 10 increases. Since the valve 16 is designed to open when the pressure of the fuel tank 11 is greater than the atmospheric pressure by, for example, 1 Kpa, the pressure of the canister 10 becomes higher than the atmospheric pressure in this case.

In this way, if the canister 10 has no leak, the pressure of the canister 10 always stays negative or becomes positive with respect to the atmospheric pressure and is never becomes equal to the atmospheric pressure when the pressure of the canister 10 is stabilized after the closure of the purge control valve 15. Accordingly, in this embodiment, it is determined that the canister 10 is normal if the difference between a detected pressure and the atmospheric pressure is greater than a reference value after the purge control valve 15 is closed and the pressure of the canister 10 is stabilized.

Figure 3:
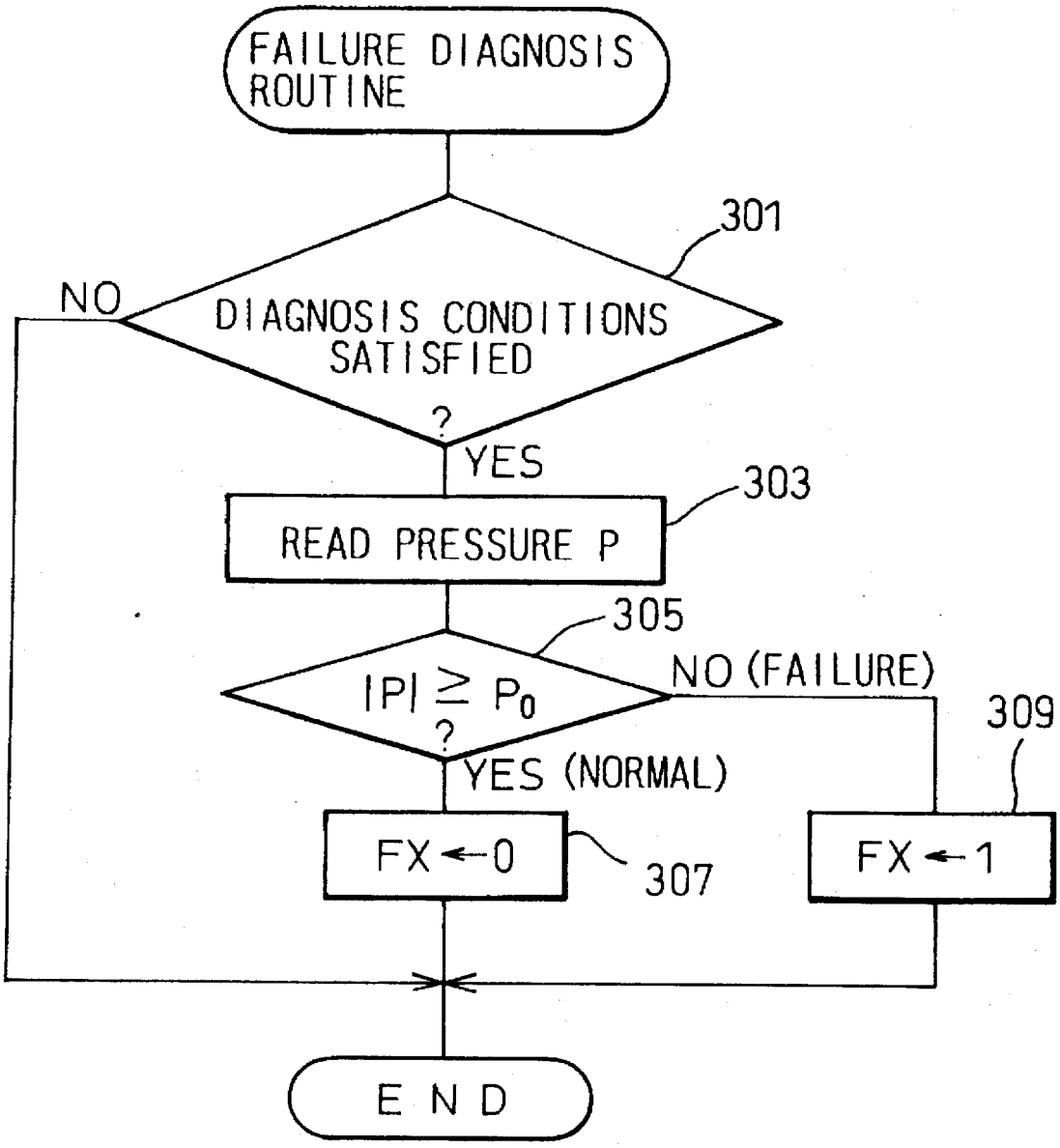
FIG. 3 is a flowchart showing the failure diagnosis according to an embodiment of the present invention.

FIG. 3 is a flowchart showing the failure diagnosis operation in this embodiment. This routine is executed by the control circuit 20 at predetermined intervals.

When the routine starts in FIG. 3, at step 301, it is determined whether the conditions to carry out a failure diagnosis are satisfied. In this embodiment, the failue diagnosis is carried out when a certain time has lapsed after the purge control valve 15 is closed and the pressure of the canister 10 is stabilized. The conditions checked by step 301 are (1) the engine is not started, or (2) the valve 15 has never been opened after the start of the engine. When the engine is stopped, the valve 15 is closed. Before the start of the engine, therefore, it is considered that the valve 15 has been closed for relatively a long time. Accordingly, if the condition (1) is satisfied, it is considered that the pressure of the canister 10 is stable. If the condition (2) is satisfied, it is considered that the pressure of the canister 10 is stable because the valve 15 has never been opened after the engine started. If the negative pressure of the intake air is large after the start of the engine, even a very small leak of the valve 15 may produce a negative pressure in the canister 10. Accordingly, in addition to the condition (2), the failure diagnosis may be carried out after the start of the engine only when the negative pressure of the intake air passage 2 after the start of the engine is smaller than a predetermined value, i.e., only when the absolute pressure of the intake air passage is higher than a predetermined value.

If the failure diagnostic conditions are satisfied in step 301, step 303 reads the output of the pressure sensor 30. The pressure sensor 30 detects a gauge pressure, i.e., the difference between the atmospheric pressure and a pressure to be detected, and therefore, the detected pressure P of the pressure sensor 30 indicates the difference between the atmospheric pressure and the pressure of the canister 10. Step 305 determines whether |P| (the absolute value of the pressure P) is greater than a positive reference value P.

If $|P| \geqq P_0$ in step 305, step 307 sets a flag FX to 0, and the routine terminates this time. If $|P| < P_0$, step 309 sets the flag FX to 1, before the routine terminates. The flag FX indicates whether the canister 10 is normal and, FX=0 means that the canister 10 is normal, and FX=1 means that the canister 10 has failed.

If the canister 10 is determined as being failed by this diagnostic routine, an alarm (not shown) may be activated to inform the driver of the automobile that a failure has occurfed in the evaporative emission control system. However, instead of activating the alarm based on only the result of the diagnosis by this routine, another failure diagnosis, which will be explained later, may be carried out to determine whether the canister 10 has really failed, to thereby improve the accuracy of the failure diagnosis.

The reference value $P_0$ used in step 305 is determined according to the size of a leak of the canister 10 to be detected. If the size of the leak to be detected is large, $P_0$ may be set at a small value, and if a leak of a small size must be detected, $P_0$ must be set at a large value. In this embodiment, the diagnostic device is directed to detect a relatively large leak. Therefore, $P_0$ is set at a relatively small value. However, in this case, if $P_0$ is set at very small value, an error in the failure diagnosis may occur due to a tolerance of the accuracy of the pressure sensor 30. Taking this into consideration, $P_0$ is set at a larger value than the tolerance of the pressure sensor 30 (for example, 0.2 to 0.3 Kpa) in this embodiment.

Since the diagnostic device according to the present embodiment carries out the failure diagnosis when the purging operation of the canister 10 is not performed (i.e., when the purge control valve 15 is closed), it is not required to stop the purging operation (as in the device in the '264 publication) to perform the diagnosis. When the purging operation is stopped, the amount of fuel supplied to the engine suddenly changes since the supply of the purge gas suddenly stops. This sometimes causes air-fuel ratio of the engine to deviate from a target air-fuel ratio and, thereby cause a worsening of an exhaust emission and fluctuation of the engine output torque. However, such troubles never occur in this embodiment, because the failure diagnosis is carried out during a purge cut period (i.e., when the purging operation is stopped in accordance with the engine operating condition).

Further, according to the present embodiment, the failure diagnosis can be performed even when the temperature of fuel in the fuel tank 11 is high if the internal pressure of the canister 10 is stable. Therefore, since the diagnosis can be performed before every engine start, thereby the frequency of performing the diagnosis is largely increased.

Next, a failure diagnosis according to another embodiment of the present invention will be explained.

In this embodiment, the purge control valve 15 is closed during the purging operation in order to perform the failure diagnosis, and if an increase in the pressure of the canister 10 within a predetermined period after the closure of the valve 15 is greater than a reference value, the embodiment determines that the canister 10 has a failure such as a leak. In this embodiment, however, if the flow rate of the purge gas from the canister 10 during the purging operation is larger than a reference value, the failure diagnosis is not performed.

During a purging operation, the purge control valve 15 is open, and the pressure of the canister 10 becomes a negative pressure determined by the degree of opening of the valve 15. The atmospheric valve 18 opens, in response to the negative pressure in the canister 10, to introduce air into the canister 10 and release fuel from the adsorbent 13 and, thereby the released fuel and air are purged through the purge control valve 15 into the intake air passage 2.

When the valve 15 is closed during the purging operation, air flowing into the canister 10 through the atmospheric valve 18 increases the pressure of the canister 10, and when the internal pressure of the canister 10 exceeds the opening pressure of the valve 18, the valve 18 closes to stop air flowing into the canister 10. Accordingly, if the canister 10 has no leak, the pressure of the canister 10 is maintained at the negative opening pressure of the valve 18, e.g., the atmospheric pressure minus 1.5Kpa. It is determined, therefore, that the canister 10 has a failure such as a leak if the pressure of the canister 10 greatly increases after the closure of the valve 15.

When the purge control valve 15 is closed during a purging operation in which the flow rate of purge gas is large, the pressure of the canister 10 sometimes greatly increases even if the canister 10 has no leak. A large flow rate of the purge gas, i.e., a large flow rate of air passing through the valve 18 into the canister 10 means a large negative pressure (a pressure largely lower than the atmospheric pressure) in the canister 10. When the pressure in the canister is largely lower than the atmospheric pressure, the diaphragm **18*b* is largely deformed against the urging force of spring 18*c*, i.e., the degree of opening of the atmospheric valve 8** is very large and passes a large amount of air.

When the purge control valve 15 is closed under this condition, since the degree of opening of the atmospheric valve 18 is large, there is a delay between the closure of the valve 15 and the closure of the atmospheric valve 18. Since the flow rate of air passing through the valve 18 is large when the valve 18 starts to close, a large amount of air flows into the canister 10 during the delay in the closure of the valve 18 and, thereby, the internal pressure of the canister 10 increases to a pressure near the atmospheric pressure. In this case, the pressure of the canister 10 greatly increases after the valve 15 is closed even if the canister 10 has no leak, and the canister may be incorrectly determined as failed. To avoid this problem, the device in this embodiment detects the flow rate of the purge gas from the canister 10 flowing into the intake air passage 2, and if the flow rate is greater than a reference value, prohibits the execution of the failure diagnosis in order to prevent an error in the diagnosis.

Figure 4:
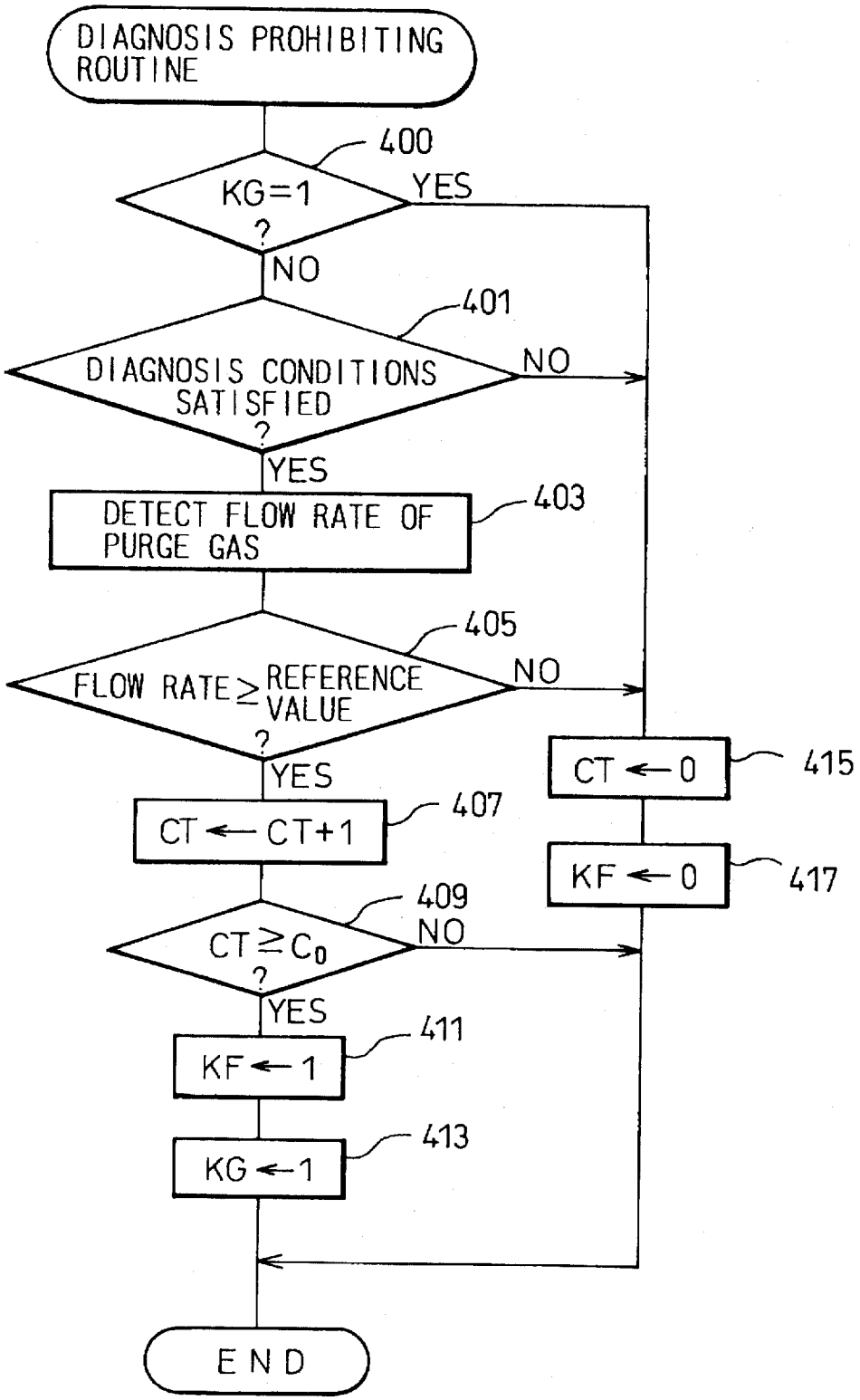
FIG. 4 is a flowchart showing the failure diagnosis according to an embodiment of the present invention.
Figure 5:
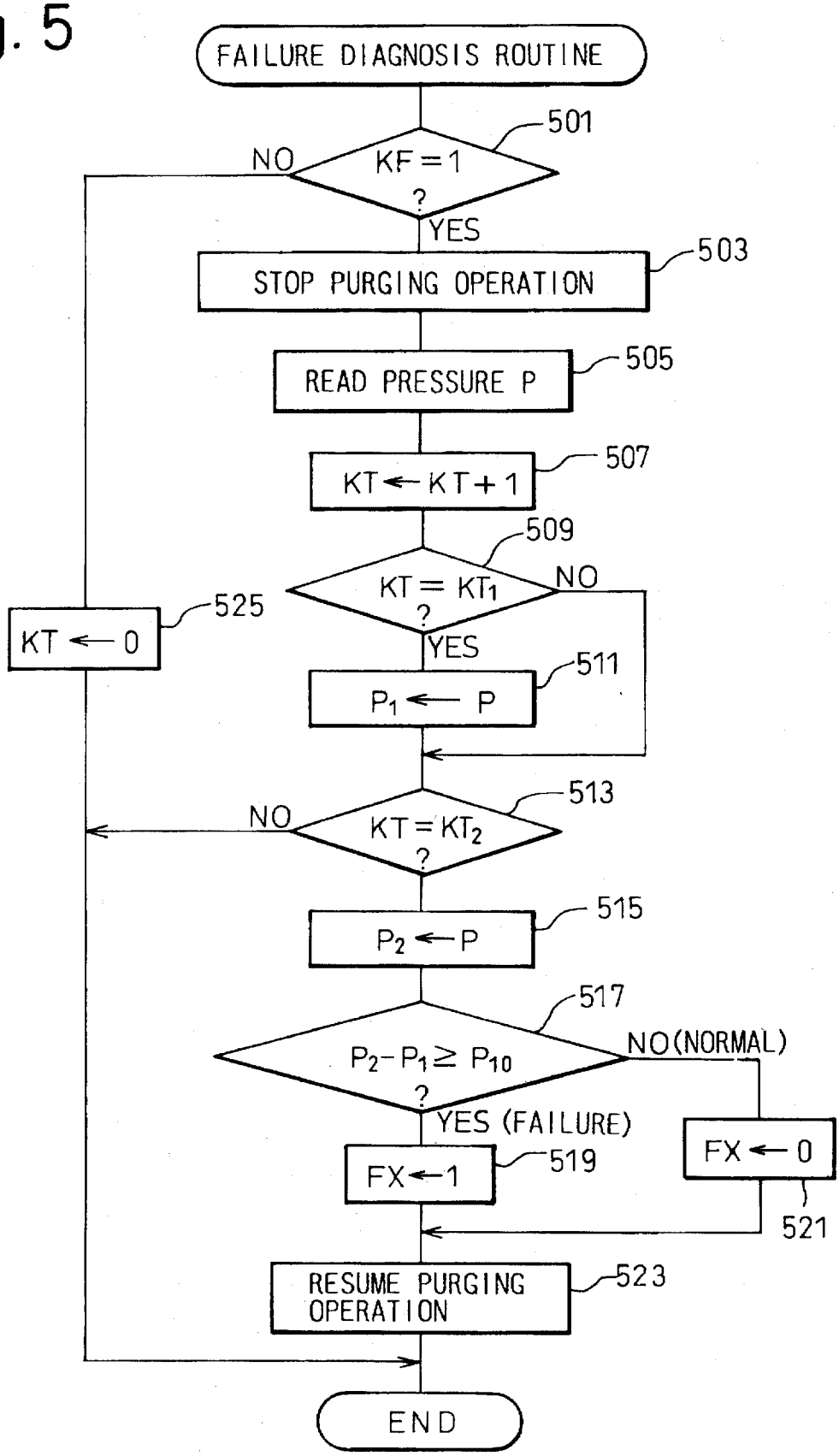
FIG. 5 is a flowchart showing the failure diagnosis according to an embodiment of the present invention.

FIGS. 4 and 5 are flowcharts showing failure diagnostic routines of the present embodiment, in which FIG. 4 shows the routine to determine whether or not a failure diagnosis can be carried out, and FIG. 5 shows the routine of the failure diagnosis. The routines of FIGS. 4 and 5 are processed by the control circuit 20 at predetermined intervals.

First, the routine of FIG. 4 will be explained. In FIG. 4, at step 401, it is determined whether the conditions to start a failure diagnosis are satisfied. If the conditions are satisfied, steps 403 and 405 determine whether the flow rate of the purge gas is less than a reference value. If both of the diagnostic conditions of step 401 and the flow rate conditions of step 405 are satisfied and if these conditions last for a predetermined period in steps 407 and 409, step 411 sets a failure diagnosis enable flag KF to 1.

In steps 407, 409, and 415, CT represents a counter for counting a period in which the conditions in steps 401 and 403 are continuously satisfied. If any one of the conditions of steps 401 and 403 is not satisfied, step 415 clears the counter CT. If the conditions are both satisfied, the counter CT is incremented by one every time the routine is executed. Thus, the value of the counter CT indicates a period in which the conditions in steps 401 and 403 are continuously satisfied. A reference value $C_0$ of step 409 is a value corresponds to, for example, about three seconds. Namely, this embodiment enables the failure diagnosis if the conditions of steps 401 and 403 are satisfied and continue for about three seconds. This period is considered to be sufficient to stabilize the pressure of the canister 10.

A flag KG in steps 400 and 413 is used to execute the failure diagnosis only once after the engine is started. The flag KG is initialized to 0 after the engine is started, and to 1 when the flag KF is set to 1. After the flag KG is set to 1, the routine proceeds from step 400 to steps 415 and 417. Therefore, the failure diagnosis is not performed.

The conditions used at step 401 to determine whether the failure diagnosis can be carried out are, for example, (1) whether the temperature of cooling water of the engine is sufficiently high (for example, above 80° C.), and (2) whether the concentration of fuel in the purge gas is not excessively high. Only when these conditions are both satisfied, is the failure diagnosis carried out.

The condition (1) is used to carry out the failure diagnosis only when the operating conditions of the engine are stable. This is required because the amount of fuel supplied to the engine temporarily fluctuates when a purging operation is stopped to carry out the failure diagnosis. The condition (2) is required to prevent a large fluctuation in the amount of fuel supplied to the engine due to the termination of the purging operation, i.e., to prevent a large fluctuation in the operating air-fuel ratio of the engine.

Next, determination of the flow rate of the purge gas performed at steps 403 and 405 is explained. The flow rate of the purge gas may be directly detected by a flow meter disposed in the purge gas passage 14. In this embodiment, however, the flow rate of the purge gas is indirectly detected based on the degree of opening of the purge control valve 15, i.e., the duty ratio of the pulse signal for driving the valve 15. When the degree of opening of the valve 15 is large, the flow rate of the purge gas is large, and when it is small, the flow rate is small. Accordingly, in this embodiment, the failure diagnosis is permitted only when the degree of opening of the valve 15, i.e., the duty ratio of the driving pulse is smaller than a reference value.

In the actual operation of the engine, however, the flow rate of the purge gas changes depending on the negative pressure of the intake air passage 2 even if the degree of opening of the purge control valve 15 is the same. Therefore, the reference value used in step 403 to check the duty ratio of the driving pulse of the valve 15, i.e., the flow rate of the purge gas is determined based on conditions in which the pressure in the intake air passage 2 becomes the lowest (in other words, the maximum negative pressure), i.e., based on conditions in which the flow rate of the purge gas becomes maximum at a given degree of opening of the purge control valve 15. Accordingly, the reference value used in this embodiment is relatively small and corresponds to, for example, a duty ratio of about 50%. If the degree of opening of the valve 15 is less than the reference value (50%), the flow rate of air flowing through the atmospheric valve 18 into the canister 10 is less than a predetermined value irrespective of the negative pressure of the intake air passage 2.

Though the flow rate of the purge gas is determined from the degree of opening of the purge control vain this in this embodiment, the flow rate may be calculated from the pressure in the intake air passage 2 and the degree of opening of the purge control valve 15. In this case, the flow rate of the purge gas may be measured experimentally in advance by operating the actual engine with different sets of the pressure in the intake air passage 2, engine speed and degree of opening of the valve 15. In this case, the measured values are stored in the ROM 22 of the control circuit 20 and, before starting the failure diagnosis, the pressure of the intake air passage 2, the engine speed, and the degree of opening of the valve 15 are measured to calculate the flow rate of the purge gas according to the relationships stored in the ROM 22. Only when the calculated flow rate is less than a reference value (for example, 30 liters per minute), is the failure diagnosis enabled.

The failure diagnosis routine of FIG. 5 will be explained.

In this routine, at step 501, the failure diagnosis operation from steps 503 to 523 are performed only when the value of the flag KF is set to 1 in the routine of FIG. 4. Step 505 reads the output of the pressure sensor 30 through the AD converter. Step 507 increments a counter KT by one. If the flag KF is not 1 in step 501, the counter KT is cleared in step 525. Only after the flag KF is set to 1, is the counter KT incremented by one in step 507 whenever the routine is executed. The counter KT indicates a time after the flag KF is set to 1, i.e., a time after the failure diagnosis is started. When the counter KT reaches a reference value $KT_1$ in step 509, step 511 stores the pressure of the canister 10 as $P_1$. When the counter KT reaches another reference value $KT_2$ which is greater than $KT_1$ at step 513, step 515 stores the pressure of the canister 10 as $P_2$. Step 517 determines whether an increase $(P_2-P_1)$ in the pressure of the canister 10 between the time $KT_1$ and the time $KT_2$ is greater than a reference value $P_{10}$ If $(P_2-P_1) \geqq P_{10}$, the canister 10 is determined as being failed, and step 519 sets a failure flag FX to 1. If $(P_2-P_1) < P_{10}$, the canister 10 is determined as being normal, and step 521 sets the flag FX to 0.

In this way, after the flag FX is set to 1 or 0 at steps 519 and 521, step 523 opens the purge control valve 15 to resume the purging operation.

The reference value $KT_1$ is set to a value corresponding to a time period sufficient to stabilize an instantaneous fluctuation in the pressure of the canister 10 due to the closure of the valve 15 (for example, 0.5 seconds). The reference value $KT_2$ is set to a value corresponding a time period sufficient to detect a pressure increase if the canister 10 has a leak (for example, 1.5 seconds).

The reference value $P_{10}$ used for failure determination is determined in accordance with the reference value $KT_2$. For example, $P_{10}$ is set at 0.3 Kpa (about 30 mm) in this embodiment.

In this embodiment, since the failure diagnosis is prohibited when the flow rate of the purge gas is large and an error in the diagnosis is possible, the reliability of the failure diagnosis is largely increased.

A failure diagnosis according to another embodiment of the present invention will be explained. In this embodiment, the reference value $P_{10}$ used for failure determination in step 517 of FIG. 5 is determined in accordance with the flow rate of the purge gas.

The previous embodiment prevents an error in the diagnosis by prohibiting a diagnosis operation when the flow rate of the purge gas is greater than the reference value. This is because an increase in the pressure of the canister 10 becomes large even if the canister 10 has no leak when the flow rate of the purge gas is large. However, an increase in the pressure of the canister 10 after the purge control valve 15 is closed differs depending on the flow rate of the purge gas just before the closure of the valve 15.

If the flow rate of the purge gas is very small, no air enters through the atmospheric valve 18 into the canister 10, and only fuel vapor from the fuel tank 11 is purged through the purge control valve 15 into the intake air passage 2. In this case, the pressure of the canister 10 is higher than the opening pressure of the valve 18, and the difference between the pressure of the canister 10 and the atmospheric pressure is small.

In this case, even if the canister 10 has a leak, an increase in the pressure of the canister 10 after the purge control valve 15 is closed is very small since the increase in the pressure does not exceed the difference between the pressure of the canister 10 and the atmospheric pressure. Namely, the leak causes only a small increase in the pressure of the canister 10. If the same reference value when a large pressure difference exists is used when only a small pressure difference exists, the canister 10 will be determined as being normal even if it leaks.

To solve this problem, a relatively large value is used as the reference value $P_{10}$ in this embodiment when the flow rate of the purge gas is large, i.e., when the increase in the pressure of the canister 10 due to a leak is large. On the other hand, when the flow rate of the purge gas is small, i.e., the increase in the pressure of the canister 10 due to a leak is small, a relatively small value is used as the reference value $P_{10}$. As a result, the failure diagnosis can be correctly performed in this embodiment regardless of the flow rate of the purge gas.

Figure 6:
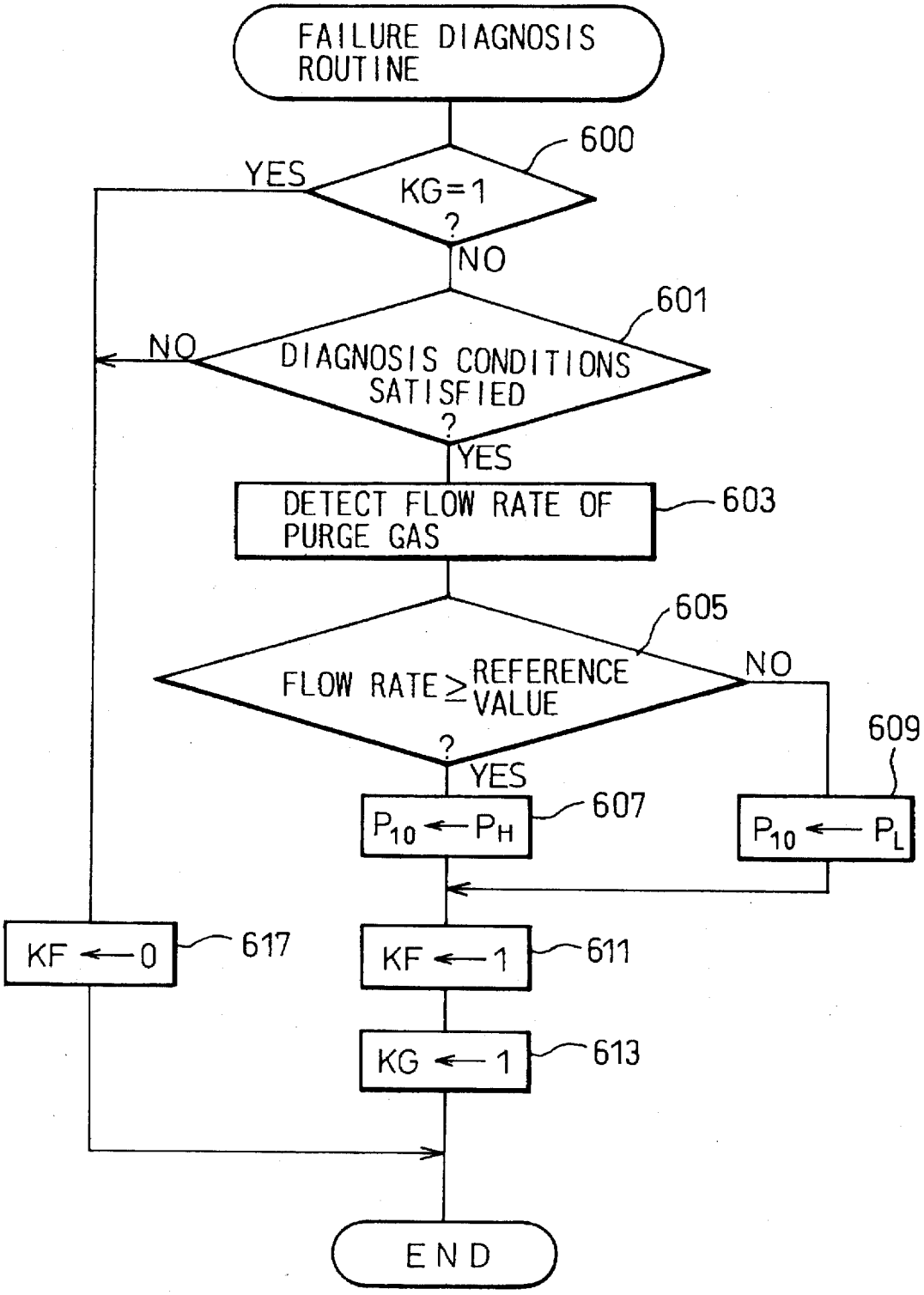
FIG. 6 is a flowchart showing the failure diagnosis according to an embodiment of the present invention.

FIG. 6 is a flowchart of the embodiment in which the reference value $P_{10}$ is changed in accordance with the flow rate of the purge gas.

In the routine in FIG. 6, if the conditions to start the failure diagnosis are satisfied at step 601, step 603 detects the flow rate of the purge gas flowing through the purge control valve 15. Step 605 determines whether the flow rate is above a reference flow rate. If it is determined that the flow rate of the purge gas is larger than or equal to the reference flow rate, step 607 sets a relatively large value $P_H$ as the reference value $P_{10}$. If the flow rate is smaller than the reference flow rate, step 609 sets a relatively small value $P_L$ as the reference value $P_{10}$.

Similar to the routine of FIG. 4, the testing of the flow rate of the purge gas in steps 603 and 605 is carried out based on the degree of opening of the purge control valve 15. In this embodiment, a degree of opening of the valve 15 which is small enough, and at which a pressure difference between the pressure of the canister 10 and the atmospheric pressure becomes small is experimentally obtained in advance, and step 605 determines whether the present degree of opening of the valve 15 is larger than or equal to the degree of opening obtained above.

In this embodiment, the flow rate of the purge gas also may be measured directly by means of a flow-meter. Further, similarly to the embodiment of FIG. 4, it is possible to calculate the flow rate of the purge gas based on the pressure in the intake air passage 2, an engine speed, and the degree of opening of the purge control valve 15. Flags KG and KF in FIG. 6 are the same as those in FIG. 4. After executing the routine in FIG. 6, the failure diagnosis routine in FIG. 5 is carried out to determine whether the canister 10 has failed according to the reference value $P_{10}$ set in the routine in FIG. 6.

The routine of FIG. 6 changes the reference value $P_{10}$ according to the flow rate of the purge gas. However, when the pressure difference between the internal pressure of the canister 10 and the atmospheric pressure is small, the speed of the increase in the pressure of the canister 10 is slow if the canister 10 has a leak. Therefore, not only the reference value $P_{10}$, but also the diagnosis time $KT_2$ in step 513 in FIG. 5 may be changed according to the flow rate of the purge gas. In this case, step 607 of FIG. 6 sets the relatively large value $P_H$ as the reference value $P_{10}$ and, at the same time, a relatively short time $KT_{2S}$ as the time $KT_2$. Further, step 609 sets the relatively small value PL as the reference value $P_{10}$ and, at the same time, a relatively long time $KT_{2L}$ as the time $KT_2$.

Next, a failure diagnosis according to another embodiment of the present invention will be explained.

The previous embodiments carry out a failure diagnosis only when the flow rate of the purge gas is smaller than a reference value, or changes a reference value used for the failure determination according to the flow rate of the purge gas, in order to prevent an error in the diagnosis. In this embodiment, a second failure diagnosis is carried out if the failure diagnosis of FIG. 5 determines that the canister 10 has failed. If the second diagnosis determines that the canister 10 is normal, the canister 10 is determined as being normal regardless of the first diagnosis.

The failure diagnosis carried out according to an increase in the pressure of the canister 10 just after the purge control valve 15 is closed is affected by the flow rate of the purge gas and the temperature of the fuel in the fuel tank 11. As a result, in some cases, a canister in the normal condition may be incorrectly determined as having failed. If the canister 10 is determined as having failed by the failure diagnosis based on an increase in the pressure of the canister 10 just after the closure of the valve 15, the embodiment carries out a second failure diagnosis according to another method to test if the canister 10 has actually failed. This eliminates an error in the diagnosis in which a normal canister is determined as having failed.

Figure 7:
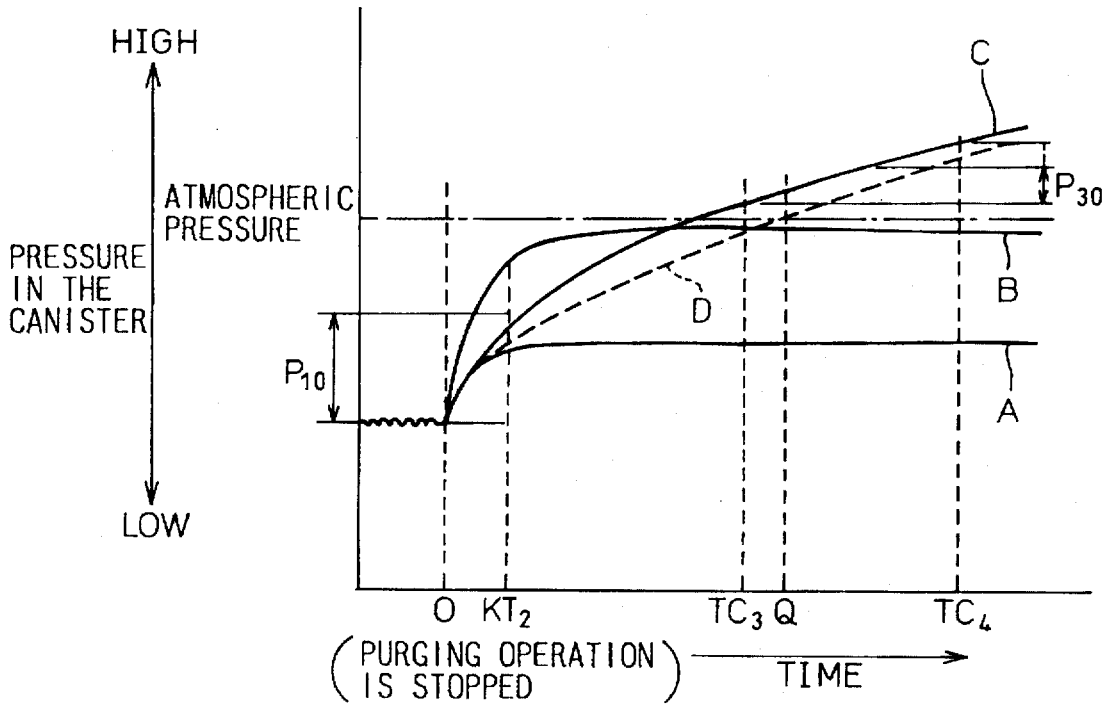
FIG. 7 explains the principle of the failure diagnosis according to the present invention.

FIG. 7 explains the principle of the embodiment. The figure shows a change in the pressure of the canister 10 after the purge control valve 15 is closed. A curve A shows a change in the pressure of the canister 10 having no leak. A curve B shows a typical change in the pressure of the canister 10 having a leak. When the canister 10 has a leak, the pressure of the canister 10 relatively quickly increases to near the atmospheric pressure after the valve 15 is closed, and thereafter, stays near the atmospheric pressure (curve B).

When the pressure of the canister 10 clearly changes along the curve B, the failure diagnosis of FIG. 5 can detect the failure of the canister 10 correctly. However, when the flow rate of the purge gas is large, or when the temperature of fuel in the fuel tank 11 is high, the pressure of the canister 10 after the valve 15 is closed follows a curve C even if the canister 10 has no leak. According to the curve C, the pressure of the canister 10 relatively quickly increases due to a delay in the closing of the atmospheric valve 18 after the closure of the valve 15 and fuel vapor flowing into the canister 10 from the fuel tank 11. Thereafter, the pressure of the canister 10 exceeds the atmospheric pressure due to the fuel vapor from the fuel tank 11. If the internal pressure of the canister 10, which has NO leak, follows the curve C, the failure diagnosis of FIG. 5 may incorrectly determine that the canister 10 has failed depending on the reference value $P_{10}$ of FIG. 7 and the diagnosis time $KT_2$ of FIG. 7.

To avoid this problem, the embodiment carries out the failure diagnosis of FIG. 5 at first. If the first diagnosis determines that the canister 10 has failed, the embodiment measures a change in the pressure of the canister 10 within a period starting when a certain time has lapsed after the first diagnosis (for example, within a period of 5 seconds starting at 10 seconds after the completion of the first diagnosis). If the change in the pressure found in the second diagnosis is greater than a reference value, the embodiment determines that the canister 10 is normal irrespective of the first diagnosis.

If the canister 10 has a leak, the pressure of the canister 10 increases to near the atmospheric pressure and then becomes unchanged as indicated by the curve B. If the canister 10 is normal, the pressure of the canister 10 continuously increases above the atmospheric pressure as indicated by the curve C due to fuel vapor flowing into the canister 10 from the fuel tank 11. Accordingly, in this embodiment, an increase in the pressure of the canister 10 is again measured a certain time after the first failure diagnosis, to correctly determine whether the pressure of the canister 10 follows the curve C. If the pressure of the canister 10 follows the curve C, it is determined that the canister 10 is normal in spite of the first diagnosis.

If the canister 10 has a leak, the pressure of the canister 10 stays around the atmospheric pressure as indicated by the curve B. Therefore, it might be possible to determine the failure of the canister 10 by measuring the pressure of the canister 10 at a time point of, for example, Q in FIG. 7, i.e., a certain time after the closure of the purge control valve 15, and by determining that the canister is normal if the measured pressure is higher than the atmospheric pressure.

The pressure of the canister 10, however, sometimes changes as indicated by a curve D in FIG. 7, depending on the flow rate of the purge gas. In this case, if the failure diagnosis is carried out only according to the pressure measured at the point Q, the canister 10 will be determined as being failed even if it is normal. Since pressure of the canister 10 that follows the curve D does not stay around the atmospheric pressure but continuously increases, this embodiment determines whether the canister 10 is normal according to not only the pressure measured at the point Q but also an increase in the pressure of the canister 10 within a predetermined period, to thereby avoid the error in the diagnosis mentioned above.

Figure 8:
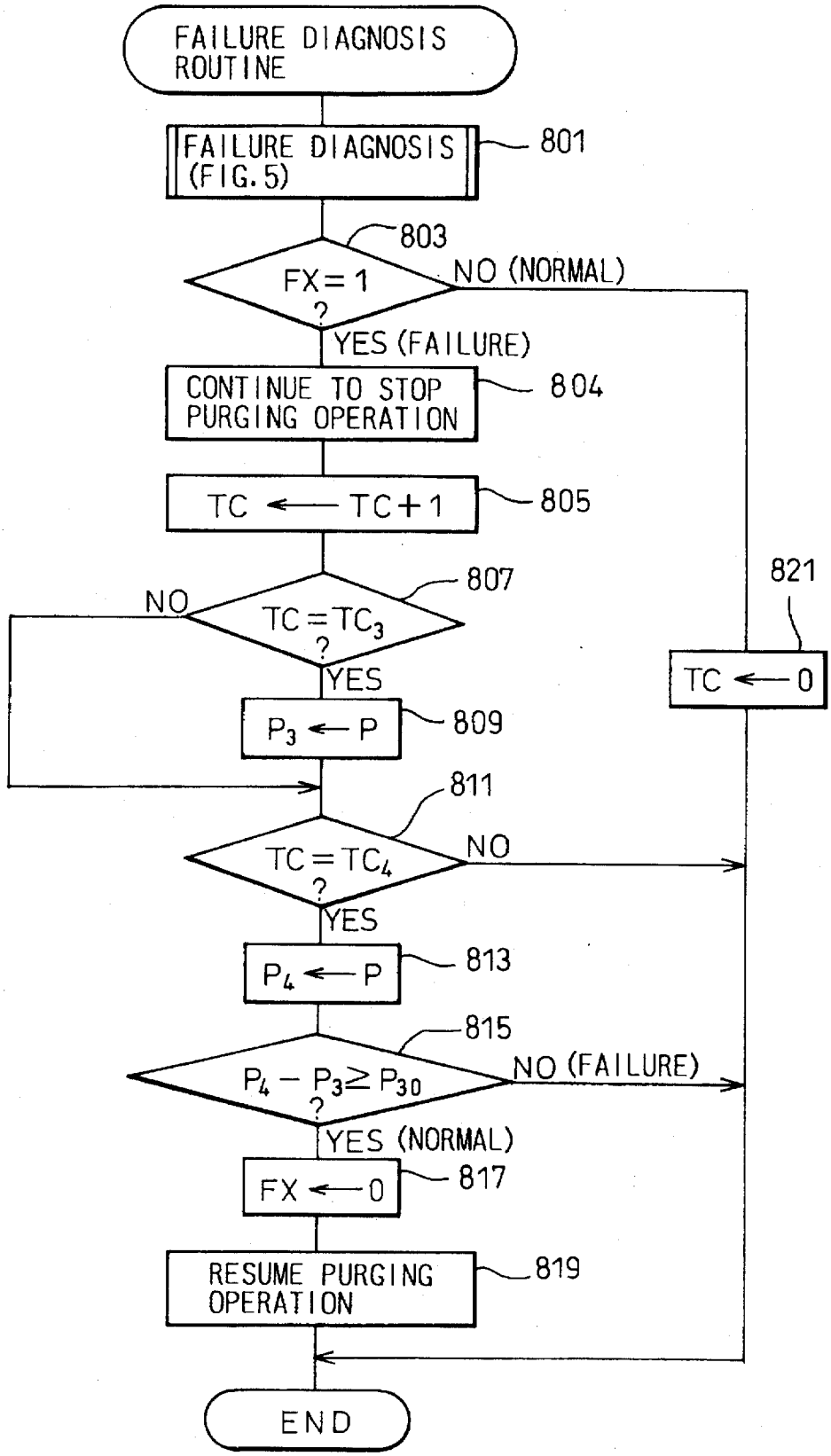
FIG. 8 is a flowchart showing the failure diagnosis according to an embodiment of the present invention.

FIG. 8 is a flowchart showing a routine of the failure diagnosis of the above embodiment.

The routine is processed by the control circuit 20 at predetermined intervals.

In the routine of FIG. 8, step 801 carries out the same failure diagnosis as explained in FIG. 5. Then, step 803 determines whether the failure flag FX set in step 801 is 1, to see if the canister 10 has been determined as being failed.

If the canister 10 was determined as being normal at step 801, step 821 clears the counter TC, and the routine terminates with the purge control valve 15 being opened at step 523 of FIG. 5.

If it is determined that the canister 10 has failed at step 801 (FX =1), a second diagnosis is carried out at steps 804 to 819. Namely, step 804 continues to stop the purging operation. Step 805 increments the counter TC by one. Thus, the counter TC counts a time after the flag FX is set to 1 in step 801.

Steps 807 and 809 store the pressure of the canister 10 detected by the pressure sensor 30 as $P_3$ when the counter TC reaches a predetermined value TC3. Steps 811 and 813 store the output of the pressure sensor 30 as $P_4$ when the counter TC reaches a predetermined value $TC_4$, which is larger than $TC_3$. Step 815 determines whether an increase ($P_4$–$P_3$) in the pressure of the canister 10 between the time $TC_3$ and the time $TC_4$ is greater than a predetermined value $P_{30}$. If $P_4-P_3 \geqq P_{30}$ in step 815, the canister 10 is determined as being normal in spite of the determination of step 801. Accordingly, step 817 sets the failure flag FX to 0, and step 819 opens the purge control valve 15 to resume the purging operation. Then, the routine terminates. If $P_4-P_3 < P_{30}$ in step 815, the flag FX is unchanged (FX =1), and the routine terminates.

The values $TC_3$ and $TC_4$ are selected in such a manner that the time between $TC_3$ and $TC_4$ is sufficiently long to stabilize the pressure of the canister 10 after it reaches the atmospheric pressure when the canister 10 has a leak. The values $TC_3$ and $TC_4$ are determined in accordance with the size of a leak to be detected. This embodiment is directed to detect a relatively large leak, and therefore, $TC_3$ and $TC_4$ are set to, for example, about 10 seconds and about 15 seconds, respectively. The reference value $P_{30}$ to test an increase in the pressure of the canister 10 is set to, for example, about 0.3 Kpa.

As understood from FIG. 8, this embodiment stops a purging operation, carries out the failure diagnosis of FIG. 5 and, only when the diagnosis of FIG. 5 determines that the canister 10 has failed, step 804 continuously stops the purging operation and carries out the second diagnosis of step 805 and the following steps. If the diagnosis of FIG. 5 determines that the canister 10 is normal, the purging operation is resumed at once (step 523 of FIG. 5), and step 804 and the following steps are not carried out. Consequently, this embodiment improves the accuracy of the failure diagnosis and shortens the period to stop the purging operation, to thereby minimize the influence of the stop of the purging operation on the operating conditions of the engine.

Figure 9:
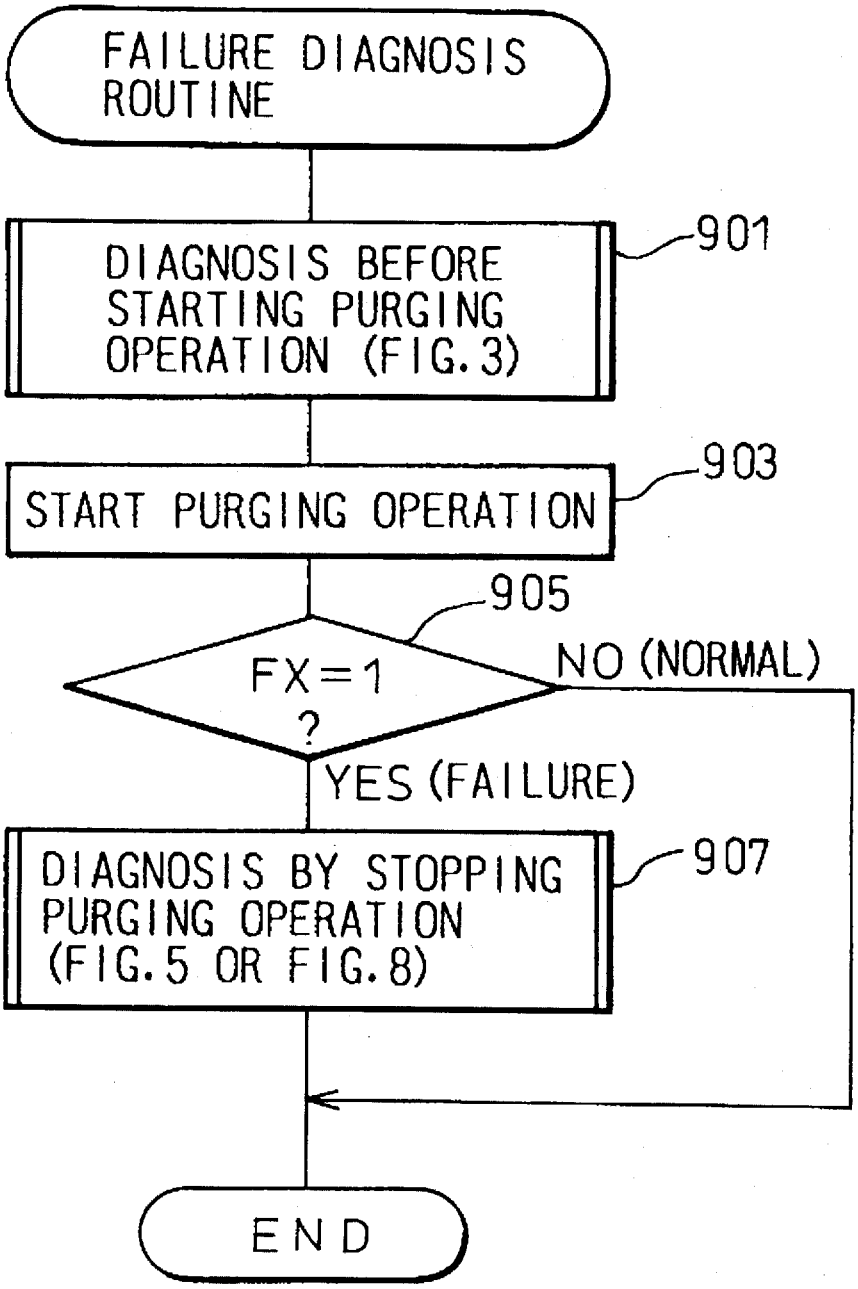
FIG. 9 is a flowchart showing the failure diagnosis according to an embodiment of the present invention.

The failure diagnoses of FIGS. 3, 5, and 8 may be carried out separately or in combinations as shown in FIG. 9. In FIG. 9, step 901 carries out the failure diagnosis of FIG. 3. Step 903 starts a purging operation after the diagnosis. Step 905 determines whether step 901 has set the failure flag FX to 1. Only when FX=1 (failure), does step 907 carry out a failure diagnosis of FIG. 5 or FIG. 8 by stopping the purging operation. If FX=0 (normal) in step 905, the failure diagnosis by stopping the purging operation is not carried out.

If step 901 determines that the canister 10 is normal, there is no need of stopping the purging operation for another failure diagnosis. This results in minimizing the adverse influence of stopping the purging operation on the operating conditions of the engine.

As explained above, according to the present invention, an error can be eliminated from the failure diagnosis of the evaporative emission control system.

Further, since the period for stopping the purging operation to perform the failure diagnosis can be minimized in the present invention, an adverse effect caused by stopping the purging operation, such as fluctuation of the operating air-fuel ratio of the engine can be minimized.

We claim:

1. A diagnostic device for an evaporative fuel emission control system, comprising:

a canister for adsorbing fuel vapor sent from a fuel tank for an internal combustion engine, a fuel vapor passage for connecting a space above a fuel level in the fuel tank to the canister, a purge gas passage for connecting the canister to an intake air passage of the engine, and a purge control valve for opening and closing the purge gas passage;

a pressure detecting device for detecting the internal pressure of the canister; and a determining means for determining that the canister is normal if the difference between the internal pressure of the canister detected by the pressure detecting device and the atmosphere is greater than a reference value, when the purge control valve is closed and internal pressure is stable, wherein the determining means operates to determine whether the canister is normal only when one of the following condition is met:

the engine is not running; and the purge control valve has been closed continuously since the engine was started.

2. A diagnostic device for an evaporative emission control system, comprising:

a canister for adsorbing fuel vapor sent from a fuel tank of an internal combustion engine, a fuel vapor passage for connecting a space above a fuel level in the fuel tank to the canister, and a purge gas passage for connecting the canister to an intake air passage of the engine;

a purge control valve for controlling the flow rate of purge gas from the canister flowing into the intake air passage through the purge gas passage;

an atmospheric valve attached to the canister which opens when the internal pressure of the canister becomes lower than the atmospheric pressure by more than a predetermined amount, to thereby introduce atmosphere into the canister;

a pressure detecting device for detecting the internal pressure of the canister;

determining means for determining that the canister has failed if an increase in the internal pressure of the canister within a predetermined period after the purge control valve is closed is greater than a reference value during the operation of the engine;

means for detecting the flow rate of the purge gas when the purge control valve is opened; and means for prohibiting the determination means from determining that the canister has failed when the flow rate of the purge gas is greater than a reference value.

3. A diagnostic device for an evaporative emission control system, comprising:

a canister for adsorbing fuel vapor sent from a fuel tank of an internal combustion engine, a fuel vapor passage for connecting a space above a fuel level in the fuel tank to the canister, and a purge gas passage for connecting the canister to an intake air passage of the engine;

a purge control valve for controlling the flow rate of purge gas from the canister flowing into the intake air passage through the purge gas passage;

an atmospheric valve attached to the canister which opens when the internal pressure of the canister becomes lower than the atmospheric pressure by more than a predetermined amount, to thereby introduce atmosphere into the canister;

a pressure detecting device for detecting the internal pressure of the canister;

determining means for determining that the canister has failed if an increase in the internal pressure of the canister within a predetermined period after the purge control valve is closed is greater than a reference valve during the operation of the engine;

means for detecting the flow rate of the purge gas when the purge control valve is opened; and means for setting said reference value according to the flow rate of the purge gas.

4. A diagnostic device for an evaporative emission control system, comprising:

a canister for adsorbing fuel vapor sent from a fuel tank of an internal combustion engine, a fuel vapor passage for connecting a space above a fuel level in the fuel tank to the canister, and a purge gas passage for connecting the canister to an intake air passage of the engine;

a purge control valve for controlling the flow rate of purge gas from the canister flowing into the intake air passage through the purge gas passage;

a pressure detecting device for detecting the internal pressure of the canister;

first determining means for determining that the canister has failed if an increase in the internal pressure of the canister within a predetermined period after the purge control valve is closed is greater than a first reference value during the operation of the engine; and second determining means for determining, when the first determining means has determined that the canister has failed, that the canister is normal if an increase in the internal pressure of the canister is greater than a second reference value within a predetermined period that starts when a predetermined time has lapsed after the first determining means has determined that the canister has failed.

* * * * *

UNITED STATES PATENT AND TRADEMARK OFFICE

CERTIFICATE OF CORRECTION

PATENT NO. : 5,669,362

DATED : September 23, 1997

INVENTOR(S) : Susumu SHINOHARA, et al.

It is certified that error appears in the above-indentified patent and that said Letters Patent is hereby corrected as shown below:

Column 5, line 48, change "takes" to --assumes--.

Column 5, line 61, after "connected" insert --to--.

Column 7, line 14, change "18bopposite" to --18b opposite--, and after "18d" insert --is--.

Column 9, line 43, after "15" insert --is--.

Column 9, line 55, change "is" to -- it--.

Column 10, line 1, change "failue" to --failure--.

Column 10, line 31, change "P." to --$P_o$.--.

Column 10, line 42, change "occurfed" to --occurred--.

Column 11, line 46, "1.5Kpa. It..." should continue on line 45 after "pressure minus".

Column 12, line 35, between "value" and "corresponds" insert --that--.

Column 13, line 28, change "vain this" to --valve 15--.

UNITED STATES PATENT AND TRADEMARK OFFICE

CERTIFICATE OF CORRECTION

PATENT NO. : 5,669,362

DATED : September 23, 1997

INVENTOR(S) : Susumu SHINOHARA, et al.

It is certified that error appears in the above-indentified patent and that said Letters Patent is hereby corrected as shown below:

Column 13, line 61, change "$P_{10}$ If" to --$P_{10}$. If--.

Column 16, line 27, delete "at".

Column 17, line 26, change "TC3." to --$TC_3$.--.

Column 18, line 18, after "engine" insert a comma.

Column 18, line 39, change "condition" to --conditions--.

Column 20, line 27, change "lapsed" to --elapsed--.

Signed and Sealed this

Twenty-eighth Day of April, 1998

Bruce Lehman

*Attest:*

BRUCE LEHMAN

*Commissioner of Patents and Trademarks*

*Attesting Officer*